US008650691B2

(12) United States Patent
Collin Delavaud et al.

(10) Patent No.: US 8,650,691 B2
(45) Date of Patent: Feb. 18, 2014

(54) STRAND GUIDING DEVICE

(75) Inventors: Thibault Collin Delavaud, Subingen (CH); Rachid Annan, Subingen (CH)

(73) Assignee: VSL International AG, Koniz (CH)

( * ) Notice: Subject to any disclaimer, the term of this patent is extended or adjusted under 35 U.S.C. 154(b) by 0 days.

(21) Appl. No.: 13/635,730

(22) PCT Filed: Mar. 26, 2010

(86) PCT No.: PCT/EP2010/054027

§ 371 (c)(1), (2), (4) Date: Sep. 18, 2012

(87) PCT Pub. No.: WO2011/116834

PCT Pub. Date: Sep. 29, 2011

(65) Prior Publication Data

US 2013/0007966 A1 Jan. 10, 2013

(51) Int. Cl.
*E01D 19/16* (2006.01)

(52) U.S. Cl.
USPC ..... 14/22; 277/609

(58) Field of Classification Search
USPC ..... 52/223.13, 223.14; 14/18–22; 277/607–610, 627
See application file for complete search history.

(56) References Cited

U.S. PATENT DOCUMENTS

| | | | | |
|---|---|---|---|---|
| 3,500,625 | A * | 3/1970 | Gokyu Isao | 57/222 |
| 4,505,081 | A * | 3/1985 | Dinis et al. | 52/223.14 |
| 4,848,052 | A * | 7/1989 | Nutzel | 52/223.13 |
| 5,208,077 | A * | 5/1993 | Proctor et al. | 427/461 |
| 6,292,967 | B1 * | 9/2001 | Tabatabai et al. | 14/22 |
| 6,354,596 | B1 * | 3/2002 | Rodriguez | 277/317 |
| 6,880,193 | B2 * | 4/2005 | Figg et al. | 14/21 |
| 7,003,835 | B2 * | 2/2006 | Figg et al. | 14/21 |
| 7,631,384 | B2 * | 12/2009 | Lecinq et al. | 14/11 |
| 7,900,306 | B2 * | 3/2011 | Bournand et al. | 14/22 |
| 7,950,093 | B2 * | 5/2011 | Brand et al. | 14/22 |

FOREIGN PATENT DOCUMENTS

| | | | |
|---|---|---|---|
| DE | 3734954 | | 4/1988 |
| DE | 69005807 | | 5/1994 |
| DE | 202005017463 | | 3/2007 |
| EP | 0 350 822 | * | 1/1990 |
| EP | 0 437 143 | * | 7/1991 |

OTHER PUBLICATIONS

International Preliminary Search Report on Patentability dated Jun. 15, 2012 for corresponding international application No. PCT/EP2010/054027.

* cited by examiner

*Primary Examiner* — Gary Hartmann
(74) *Attorney, Agent, or Firm* — Pearne & Gordon LLP

(57) ABSTRACT

The present invention relates to a strand guiding device that comprises a curved body having a first end and a second end. The strand guiding device further comprises at least one channel extending from the first end to the second end inside the strand guiding device, the channel being arranged to be traversed longitudinally by a strand of a cable, and further arranged to hold the strand in place when under tension. The body of the guiding device is filled with a protective material for protecting the strand from corrosion and allowing later removal of the strand.

22 Claims, 5 Drawing Sheets

STRAND GUIDING DEVICE

TECHNICAL FIELD

The invention relates to a new structure for a strand guiding device to be used for instance in bridge pylons. More specifically, the invention relates to a new strand corrosion protection concept in strand guiding devices. The invention likewise relates to a corresponding method of protecting strands in saddles. The invention likewise relates to constructions comprising the aforementioned guiding device for strands.

BACKGROUND OF THE INVENTION

The invention applies more specifically, but not exclusively, to guiding devices for tension members, such as strands of cables which, made up of a multiplicity of strands, are used in civil engineering and building activities.

Numerous structures and notably bridges comprise cables which are used in particular to support elements of these structures. Such cables are stressed in traction between their opposite ends, but frequently saddles, also known as guiding devices, are used for holding the cables in such a manner as to deviate them in whatever way in the direction in which they must extend.

The function of a saddle of the type cited above is thus to permit lateral and/or longitudinal and local holding of a cable and transfer of the stress caused by this deviation to a support, such as a bridge pylori, provided for this purpose. A saddle of the aforementioned type is intended to be interposed between the support and the cable such as inside a pylori for stay cables or a bridge girder diaphragm for external tendons. Conventional saddles used one simple steel pipe for all strands, i.e. the bundle of strands placed inside one common pipe. In some solutions individual steel tubes were provided for the strands. More recently, saddles with holes or channels (obtained by so-called void formers which are removed after the grouting) for each individual strand were developed. In some solutions these holes have a V shape to improve the clamping effect. Saddles with individual tubes or channels are conceived to allow individual local support of each strand of a cable.

To this end, a recent saddle comprises at least one bearing area for guiding a strand of a cable, and preferably a plurality of bearing areas for deviation, each permitting the individual support of one of the strands of a cable.

In known saddle solutions, the saddle is composed of a round or rectangular or otherwise shaped steel box filled, after strand installation, with a high-strength cement grout. Strands are arranged to traverse the saddle longitudinally inside the rectangular steel box. In such solutions, the strands can be unsheathed to increase friction between the strands and some parts of the saddle. In the case of fully grouted and bonded strands, the cement mortar can also protect the unsheathed strands from corrosion. However, the disadvantage in this case is that the strands are tightly in place in the solidified cement mortar, and for this reason the strands cannot be replaced individually. In the context of this application, the term corrosion is used to mean any process, for example chemical or electrolytic, which can have a deleterious effect on the chemical integrity, and hence the mechanical properties, of the strands.

It is also possible to insert in the saddle curved tubes or channels for holding the strands in place in the saddle. The saddle conventionally comprises at least as many tubes as the guide cable, also known as the stay cable, comprises strands. Each strand is then arranged to traverse one tube longitudinally. This solution does not require subsequently filling the saddle with cement mortar. An advantage of this solution is that it allows the replacing of the strands individually. A disadvantage of this solution is, however, that the tubes and strands are susceptible to corrosion.

It is the aim of the present invention to provide an improved saddle concept so that the shortcomings of the prior art can be overcome.

SUMMARY OF THE INVENTION

According to a first aspect of the invention, a bridge saddle is provided, the bridge saddle comprising a body having a first end and a second end, the bridge saddle comprising at least one channel extending from the first end to the second end inside the bridge saddle, the channel being arranged to be traversed longitudinally by a strand of a cable, and further arranged to hold the strand in place when under tension, the body of the bridge saddle comprising protective material arranged to protect the strand from corrosion, wherein the channel is arranged so that it allows the strand to be fed through it, and the channel and the protective material allow later removal and replacement of the strand in the bridge saddle, wherein the protective material is non-hardening, solid, flexible and elastic polymeric material.

The proposed solution offers several advantages. The strands that traverse the guiding device can be replaced individually. Furthermore, the injected protective material protects the strands from corrosion, and also reduces fretting corrosion risk. If needed, the protective filling material can also be replaced easily.

Sealing means can also be provided at both ends of the body to further protect the interior of the body and to prevent the protective material from escaping from the body.

According to a second aspect of the invention, there is provided a method for protecting strands from corrosion in a bridge saddle comprising a body having a first end and a second end, the bridge saddle comprising at least one channel extending from the first end to the second end inside the bridge saddle, the channel being arranged to be traversed longitudinally by a strand of a cable, and further arranged to hold the strand in place when under tension, the method comprising threading the strand through the channel in the bridge saddle and after this injecting into the body of the bridge saddle protective material for protecting the strand from corrosion, wherein the channel is arranged so that it allows the strand to be fed thorugh it, and the channel and the protective material allow later removal and replacement of the strand in the bridge saddle, wherein the protective material is non-hardening, solid, flexible and elastic polymeric material.

Other aspects of the invention are recited in the dependent claims attached hereto.

BRIEF DESCRIPTION OF THE DRAWINGS

Other features and advantages of the invention will become apparent from the following description of a non-limiting exemplary embodiment, with reference to the appended drawings, in which.

DETAILED DESCRIPTION OF AN EMBODIMENT OF THE INVENTION

An embodiment of the present invention will be described in the following in more detail with reference to the attached figures.

Figure 1:
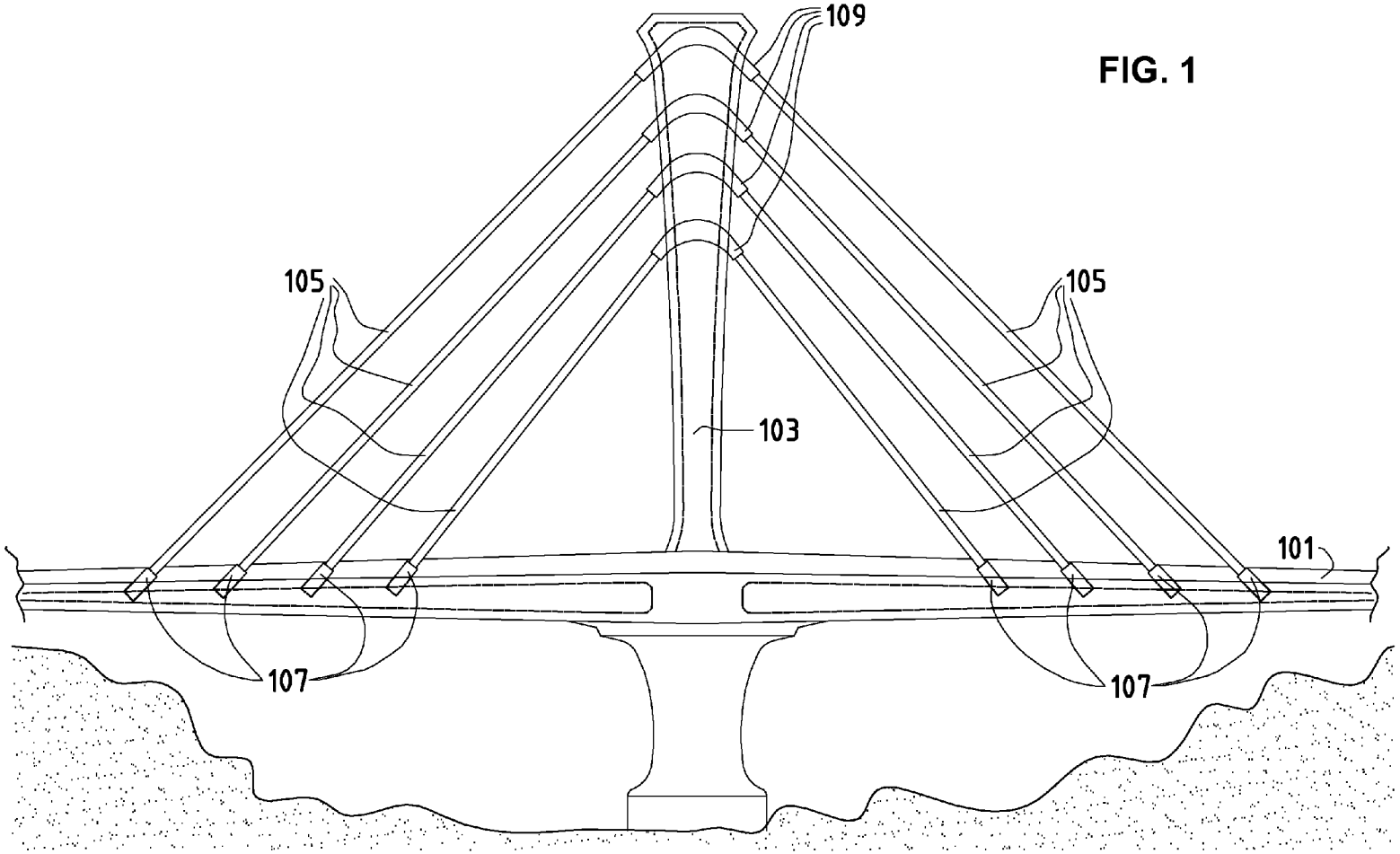
FIG. 1 is a simplified side view of a cable-stayed bridge showing bridge saddles.

FIG. 1 shows a cable-stayed bridge where the saddle in accordance with the present invention can be applied. A cable-stayed bridge generally includes:

- a deck 101, which includes a structural member, for example a concrete or metallic structural member, with, also for example, at least one internal chamber (however, could also be an open cross deck cross section),
- at least one pylori 103, the pylori 103 including at least one substantially upright element, each pylori 103 including namely a first part, which extends under the deck, and a second part, which extends above the deck,
- a multiplicity of stay cables 105.

Each stay cable 105 extends between two deck anchorages 107 situated on the deck 101 in such a way that each stay cable 105 traverses a strand guiding device 109, hereinafter referred to as a bridge saddle, situated in the upper part of the pylori 103.

The stay cable elements used in the field of construction of cable-stayed or suspension bridges are generally corrosion-protected (for years) by a layer, which can be grease, wax or gel-based, and a sheath surrounding the protective layer. However, the presence of the protective layer and of the sheath increases the diameter of the strand.

Conventionally, the strands are each made up of a multiplicity of wires, generally metallic, but not limited thereto. For example, in some solutions each strand comprises a group of seven wires. The strands often have a cross section which is inscribed in a circle. Each cable 105 usually comprises a plurality of strands.

Figure 2:
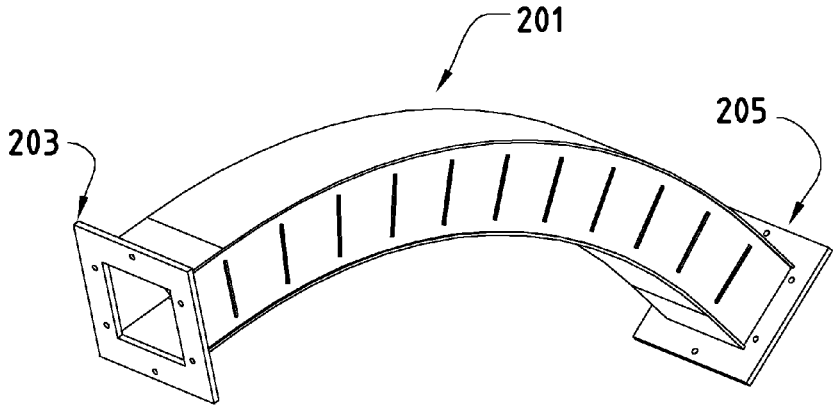
FIG. 2 is a perspective view of a saddle body.

FIG. 2 shows a perspective view of a body 201 of a saddle 109 that is arranged to be traversed longitudinally (following the longitudinal axis of the body) by strands of a stay cable 105. Designated by longitudinal axis is a curved path which extends along the longitudinal dimension of the body 201, but not necessarily in the middle position with respect to the outer dimensions of the saddle body 201.

In this example, the body 201 is a curved rectangular steel box that has a first open end 203 and a second open end 205. The cross section of the body 201 could of course be round or shaped in other form to enclose the bundle of strands.

Figure 3:
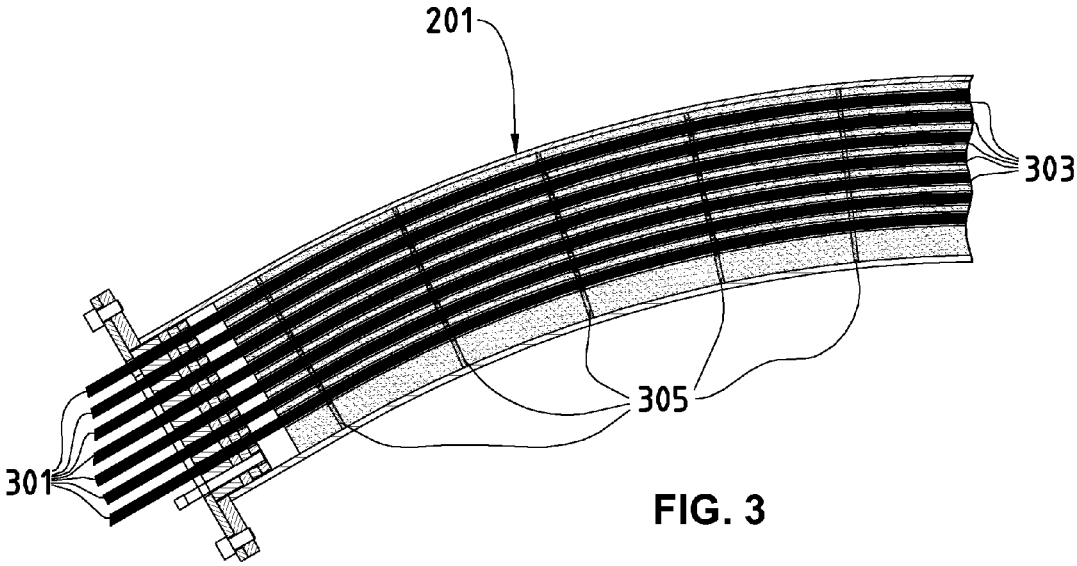
FIG. 3 is a cut side view showing part of a saddle, with strands in place, seen in section along a longitudinal plane.

FIG. 3 illustrates a side view of one part of the body 201 in the longitudinal plane. In this specific example, the side view of the saddle body 201 shows seven strands 301. Also shown are channels 303, in this example steel tubes, which however could also be aluminium or plastic tubes, one tube 303 being provided for each strand 301, and the strands 301 being arranged to traverse the tubes 303 longitudinally. Each tube 303 of the body comprises a curved longitudinal axis and at least one first part which, situated in principle at the side of the intrados of the longitudinal axis, permits, within the limit of the length of the tube, the support of the strand 301 on a portion of the peripheral face of the strand 301. The tubes 303 follow the curvature of the saddle body 201.

Tube supporting elements 305 are also provided to support the tubes 303 and hold the tubes 303 in place inside the saddle body 201. The purpose of the supporting elements 305 is also to support the void formers (in the solution where these are needed) and to take some transverse forces caused by the deviation forces of the curved and stressed strands. These supporting elements 305 are arranged to be approximately perpendicular with respect to the tubes 303.

In this specific example, the part of the strands 301 traversing the tube or channel 303 is not sheathed (the strands being initially sheathed, but the sheath is removed in the region of the saddle as part of the installation process) to increase the friction between the strand 301 and the tube 303. This has the advantageous effect of holding the strand 301 in place even when under significant differential tension between the first end 203 and the second end 205. However, the unsheathed strands are susceptible to corrosion, and for this reason, in accordance with the present invention, protective material is provided in the saddle body 201 (as will be explained later in more detail) to prevent corrosion from occurring. Furthermore, the part of the strand 301 that is not inside the tube 303 is sheathed to provide protection, e.g. against corrosion. The protective material may be polymeric. The sheathing can be made up of polyethylene material, for example. The space between the individual tubes is advantageously filled with a hardening material such as cernentitious mortar.

Different shapes of the tube cross sections have different damping effects, and by using V-shaped cross sections at the side of the intrados, a relatively high clamping effect can be obtained. In this case the cross sections of the tube 303 and strand 301 are not of complementary shape.

However, in traditional solutions the tubes 303 each have a cross section of substantially complementary shape to that of the strand 301 which they receive. For example, when the strands 301 of the cable 105 each have a cross section which inscribes a circle, each tube 303 has a cross section substantially circular of an internal diameter greater than the circle in which the cross section of a strand 301 is inscribed in order to facilitate the insertion of the strand 301 through the tube 203.

In the above illustrated solution, the space between individual tubes is grouted. In another solution (not illustrated in the figures), channels are formed inside the saddle body 201 by void formers which are removed after the filler around has hardened. Also in this solution the channels can have a V shape to improve the clamping effect. In this solution the absence of the metal tubes 303 is even advantageous in the sense that the strands 301 would then not be in contact with metal tubes 303 prone to corrosion or where the contact to metal could cause fretting fatigue to the strand.

In accordance with the present invention, the interior of the saddle body contains a protective material for protecting the strands 301 and/or the tubes 303 from corrosion. As stated above, the injected protective material can be polymeric material or other similar material, as long this filler keeps oxygen arid moisture out of the saddle body 201 and allows removal of the strands 301. For instance, the polymeric material is obtained by mixing two types cf liquids, enabling the polymerisation process to take place. The obtained polymeric material is water repellent (does not mix with water), and is not permeable to gases. The injection is advantageously done after mixing of the liquids, before the solidifying (polymerisation) process has properly started. After mixing and injection, the obtained mixture will become solid, but will not harden and thus remains flexible, soft and elastic.

The bridge saddles 109 are often located high above the ground level, and for this reason a special arrangement for the injection is needed, as explained below.

Figure 4:
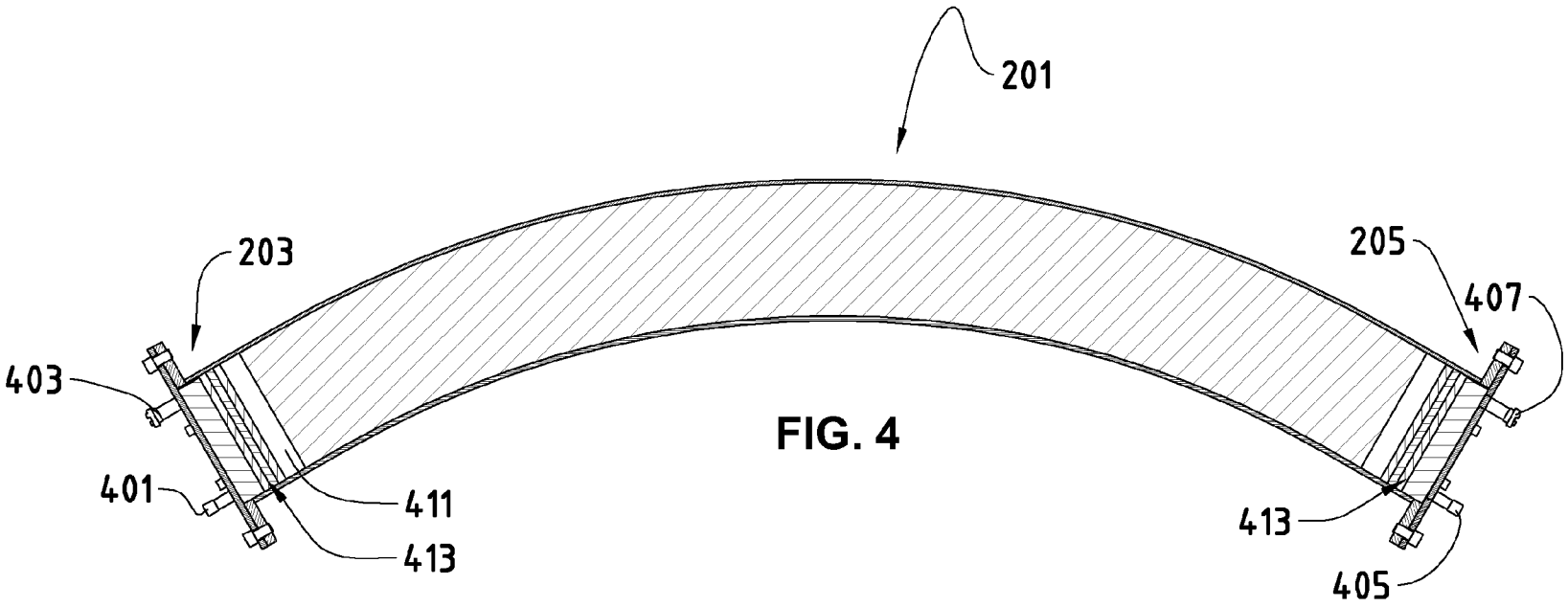
FIG. 4 is a cut side view of the saddle, including sealing means, seen in section along a longitudinal plane.

Referring now to FIG. 4, the protective material is advantageously injected into the saddle body 201 through one of the injection tubes 401; 405 located at both ends, at the bottom of the body 201. In this example, there are two injection tubes so that the injection is done through one of the injection tubes 401; 405, but it would be also possible to use both injection tubes simultaneously. The injection tubes 401; 405 are connected to a filling tank (not shown).

At the upper part of both ends of the saddle 201 body there are shown a first vent 403 and a second vent 407, one of them connected to a vacuum pump (not shown). Usually only one vent is used at a time so that the purpose of the vent is to allow air to escape during injection. To improve the filling of the interior of the saddle body 201, the air is first sucked away from the saddle body 201 through one of the vents 403; 407 by using the vacuum pump. This has the effect that all the voids in the interior of the saddle body can be filled with the protective material. In the case where the interior of the saddle body is injected, then the protective material would fill the space between the strand 301 and the channel wall. The benefit of doing the injection from below and sucking the air from above is that the air can be better removed from the saddle body 201. Usually the air is sucked from the end opposite to the end of injection to improve the filling. Of course it is possible to do these operations at the same end.

The protective material injection is done once all the strands 301 (not shown in FIG. 4) are in place inside the saddle body 201. To facilitate the filling with protective material, the protective material is first injected through one of the injection tubes 401; 405 into a filling chamber 411. From the filling chamber 411 the protective material spreads all around the interior of the saddle body 201 assisted by vacuum application into all individual tubes, and then some time after completion of injection, it starts solidifying. The injection is stopped once the injected material starts to run out of the saddle body through the vent located at the opposite end. Once solidified, the polymeric filler sticks well to metal surfaces.

Figure 5:
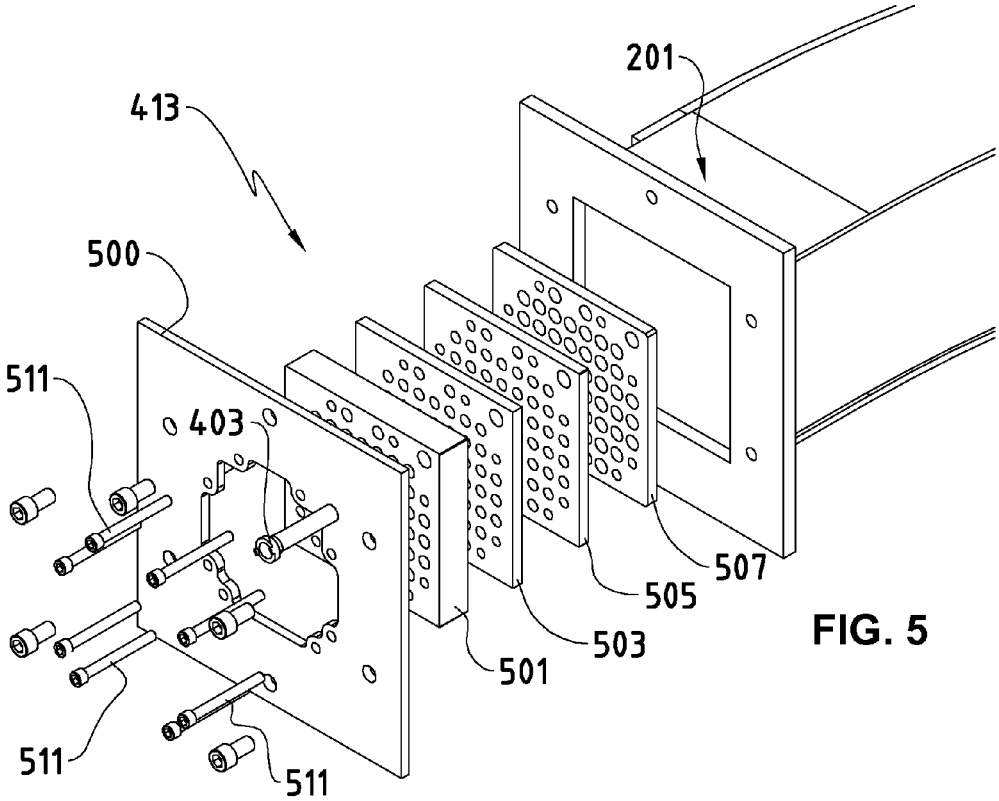
FIG. 5 illustrates a sealing arrangement for the saddle.
Figure 6:
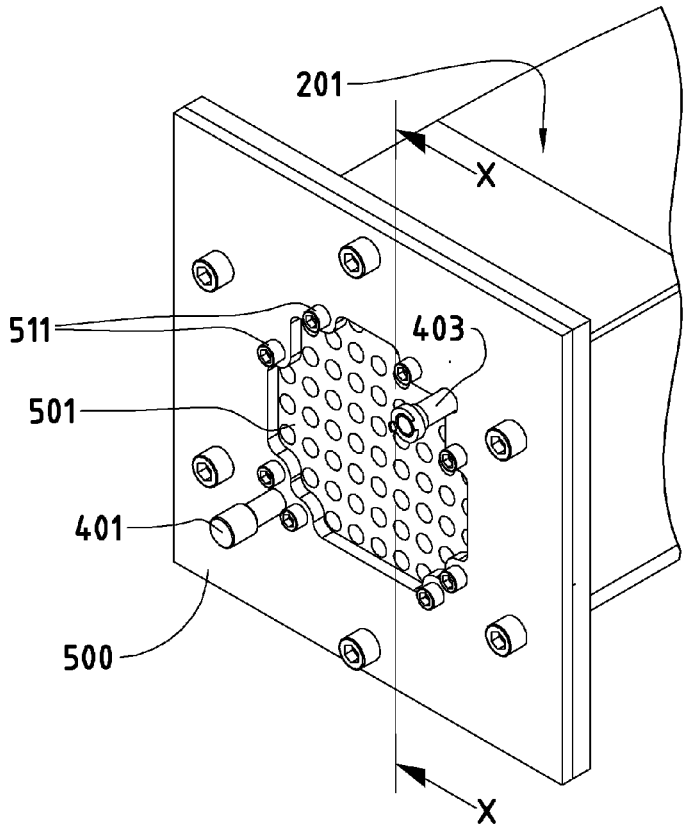
FIG. 6 illustrates the sealing arrangement of FIG. 5 when in place in the saddle.

On both ends of the saddle body 201 is an end structure or sealing arrangement 413, described in more detail with reference to FIGS. 5-7.

The sealing arrangement 413 comprises several flat elements, in this example five elements: the outermost element from the body 201 is a front pressing plate 500, the next element being a transition pad 501, the next element being a sealing pad 503, the following being a pressing pad 505, and the element closest to the body 201 is a rear pressing plate 507. The pressing pad 505 and the rear pressing plate 507 together can be referred to as a rear pressing element. Holes are provided in the transition pad 501, the sealing pad 503, the pressing pad 505 and the rear pressing plate 507 for the strands 301 to pass through. The shape of the holes is advantageously complementary to the shape of the strands 301 that pass through these holes to guarantee a good sealing effect. Therefore, the sealing arrangement 202 advantageously makes leak tightness around the strands 301 when the strands 301 traverse the sealing arrangement 202.

The front pressing element 500 is a rigid element, and in this example it is a steel plate. In the example shown in the figures, there are no holes in the front pressing plate 500 for the strands to pass through to prevent any contact of steel strand to steel plate, but a solution with holes for the strands 301 is also possible. However, holes are provided for tightening means to pass through for pressing the transition pad 501, the sealing pad 503, the rear pressing pad 505 and the rear pressing plate 507 against the front pressing plate 500.

The transition pad 501 is deformable, and can be made of polyethylene, for instance, and its primary function is to take transverse deviation forces from the strands and to dampen the movements of the strands 301, but its function is also to seal and protect. When considered in the direction of the holes passing through the elements, the width of the transition pad 501 is larger than the width of the other elements of the sealing arrangement 413. The width of the transition pad 501 can be two or three times the width of the sealing pad 503, for instance. This has the advantageous effect of resisting relatively large deviation forces and of dampening relatively strong strand 301 movements.

Figure 7:
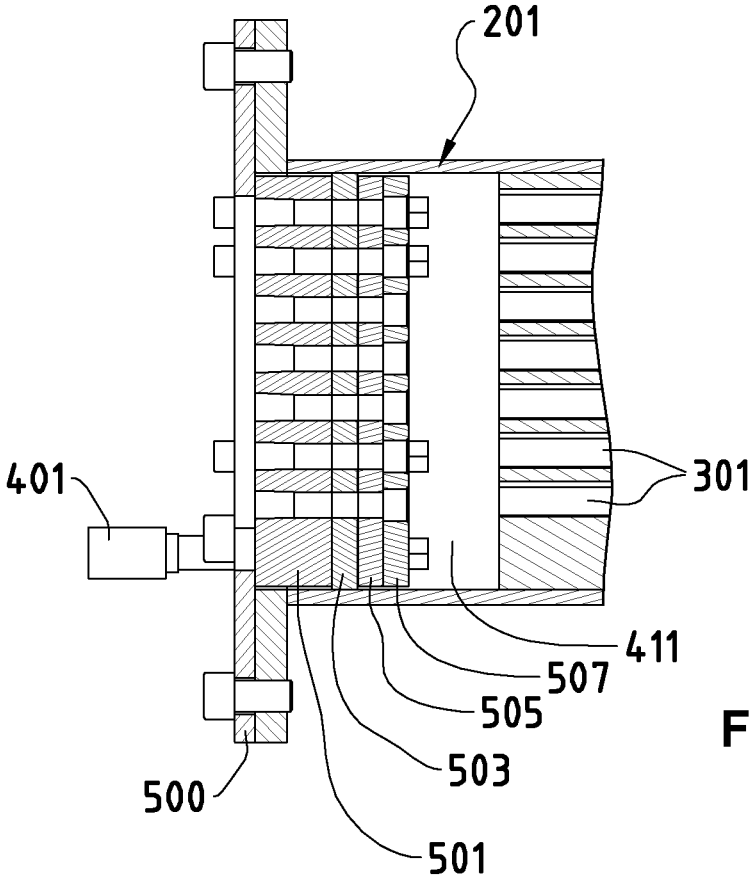
FIG. 7 is a cut view showing the sealing arrangement of FIG. 5 along the line X-X of FIG. 6.

As can be seen in FIG. 7, the holes that pass through the transition pad 501, the sealing pad 503, the pressing pad 505 and the pressing plate 507 have a chamfered end where the transition pad 501 is pressed against the front pressing plate 500. The chamfer angle can be a few degrees, e.g. 2 degrees. This further facilitates the movements of the strands 301 without bearing against a sharp edge. The chamfer angle is also useful if the strands 301 are deviated intentionally. When the strands 301 move due to loads on the cable for instance, the transition pad 501 may undergo elastic deformation. This type of deformation is reversible. In other words, once the forces are no longer applied, the transition pad 501 returns to its original shape. Thus, it provides a smooth transition zone for the strands 301 that traverse the sealing arrangement 413.

The primary function of the non-rigid sealing pad 503 is to seal the interior of the saddle body 201 from the outside environment. This pad ensures that the moisture from the outside of the saddle body 201 cannot penetrate into the interior part of the body 201, and it is also intended to prevent the injected protective material from flowing away from the body 201. The sealing pad 503 can be for instance made of neoprene, such as ethylene propylene diene monomer rubber. The actual sealing is made by compression of the sealing pad 503 between the transition pad 501 and the pressing pad 505, both advantageously made of polyethylene.

The rigid pressing pad 505, made for instance of polyethylene or polyprolylene, is used together with the rigid steel rear pressing plate 507 to compress the transition pad 501 and the sealing pad 503 against the front pressing plate 500. For this purpose screws 511 or corresponding tightening means are provided to provide sufficient compression. The pressing pad 505 and the rear pressing plate 507 also act as a spacer for the strands 301.

When installing the saddle 201 and the strands 301, following steps are performed: The saddle 109 is first installed onto a bridge pylon 103 with sealing 413 pre-installed but not tightened. The strands 301 are then threaded through the saddle body 201. After this, the strands 301 can be stressed, and the transition pad 501 and the sealing pad 503 are compressed between the front pressing plate 500 and the rear pressing element. Then the protective material can be injected into the saddle body 201.

As explained earlier, the teachings of the present invention are equally applicable to suspension cables or deviators of external tendons in a bridge deck.

While the invention has been illustrated and described in detail in the drawings and foregoing description, such illustration and description are to be considered illustrative or exemplary and not restrictive, the invention being not limited to the disclosed embodiment. Other embodiments and variants are understood, and can be achieved by those skilled in the art when carrying out the claimed invention, based on a study of the drawings, the disclosure and the appended claims.

In the claims, the word "comprising" does not exclude other elements or steps, and the indefinite article "a" or "an" does not exclude a plurality. A single processor or other unit may fulfil the functions of several items recited in the claims. The mere fact that different. features are recited in mutually different dependent claims does not indicate that a combination of these features cannot be advantageously used. Any reference signs in the claims should not be construed as limiting the scope of the invention.

The invention claimed is:

1. A bridge saddle comprising a body having a first end and a second end, the bridge saddle comprising at least one channel extending from the first end to the second end inside the bridge saddle, the channel being arranged to be traversed longitudinally by a strand of a cable, and further arranged to hold the strand in place when under tension, the channel comprising protective material arranged to protect the strand from corrosion, wherein the channel is arranged so that it allows the strand to be fed through it, and the channel and the protective material allow later removal and replacement of the strand in the bridge saddle, wherein the protective material is non-hardening, solid, flexible and elastic polymeric material.

2. A bridge saddle according to claim 1, wherein the channel in the body is filled with the protective material around the strand.

3. A bridge saddle according to claim 1, wherein the part of the strand that traverses the channel is unsheathed.

4. A bridge saddle according to claim 1, wherein the body is curved and the channel follows the curvature of the body.

5. A bridge saddle according to claim 1, wherein at least one of the first end and the second end of the bridge saddle comprises a sealing arrangement.

6. A bridge saddle according to claim 1, wherein the protective material is arranged to be injected under vacuum assistance in the bridge saddle.

7. A bridge saddle according to claim 1, wherein the channel has a V shape in cross section.

8. A bridge saddle according to claim 1 the at least one channel being a plurality of channels, wherein the bridge saddle further comprises a filling chamber for receiving the protective material from where the protective material is arranged to fill said channels in the interior of the bridge saddle.

9. A bridge saddle according to claim 1, wherein the bridge saddle further comprises at least one injection tube at the first end or at the second end for injecting the protective material and at least one vent at the first or second end for connecting to a vacuum pump and for venting.

10. A bridge saddle according to claim 1 wherein the at least one channel is a plurality of channels that are either formed by removable void formers or by individual tubes.

11. A bridge saddle according to claim 1 the at least one channel being a plurality of channels, wherein a space between each of said channels is filled with a hardening material.

12. A method for protecting strands from corrosion in a bridge saddle comprising a body having a first end and a second end, the bridge saddle comprising at least one channel extending from the first end to the second end inside the bridge saddle, the channel being arranged to be traversed longitudinally by a strand of a cable, and further arranged to hold the strand in place when under tension, the method comprising threading the strand through the channel in the bridge saddle and after this injecting into the channel protective material for protecting the strand from corrosion, wherein the channel is arranged so that it allows the strand to be fed through it, and the channel and the protective material allow later removal and replacement of the strand in the bridge saddle, wherein the protective material is non-hardening, solid, flexible and elastic polymeric material.

13. A method according to claim 12, wherein the protective material is injected under vacuum assistance in the bridge saddle.

14. A method according to claim 12 wherein the channel in the body is filled with the protective material around the strand.

15. A method according to claim 14 wherein the at least one channel is a plurality of channels that are each either formed by a removable void former or by an individual tube.

16. A method according to claim 12 the at least one channel being a plurality of channels, wherein the bridge saddle further comprises a filling chamber and at least one injection tube at the first end or at the second end, wherein the protective material is injected through said injection tube into said filling chamber from where the protective material is arranged to fill all of said channels in the interior of the bridge saddle, and at least one vent at the first or second end for connecting to a vacuum pump and for venting.

17. A method according to claim 12 the at least one channel being a plurality of channels, wherein a space between each of said channels is filled with a hardening material.

18. A bridge saddle comprising a body having a first end and a second end, the bridge saddle comprising a plurality of channels extending from the first end to the second end inside the bridge saddle, a plurality of strands of cable, each of said channels being arranged to be traversed longitudinally by one of said strands disposed inside said channel, and said channels being further arranged to hold said strands in place when under significant differential tension between the first end and the second end but permit said strands to be movable inside said channels, protective material filling said channels around said strands to protect said strands from corrosion, wherein said channels are arranged so as to allow said strands to be fed through said channels, and said channels and said protective material allow later removal and replacement of said strands in the bridge saddle, wherein the protective material is non-hardening, solid, flexible and elastic polymeric material, and a hardening material disposed in the bridge saddle between said channels.

19. A bridge saddle according to claim 18 wherein each of said channels has a V shape in cross section.

20. A bridge saddle according to claim 18 wherein each of said channels is formed by a removable void former or by an individual tube spaced apart in said hardening material.

21. A bridge saddle according to claim 20 wherein each of said tubes has a V shape in cross section.

22. A bridge saddle according to claim 20 wherein said tubes are made of metal or plastic.

* * * * *

UNITED STATES PATENT AND TRADEMARK OFFICE

CERTIFICATE OF CORRECTION

PATENT NO. : 8,650,691 B2
APPLICATION NO. : 13/635730
DATED : February 18, 2014
INVENTOR(S) : Thibault Collin Delavaud et al.

It is certified that error appears in the above-identified patent and that said Letters Patent is hereby corrected as shown below:

In the Specification

Column 1, line 29, please delete the word “pylori” and replace it with “pylon”

Column 4, line 25, please delete the word “damping” and replace it with “clamping”

Signed and Sealed this
Thirtieth Day of September, 2014

Michelle K. Lee

Michelle K. Lee
*Deputy Director of the United States Patent and Trademark Office*